US009128451B2

(12) United States Patent
Goda et al.

(10) Patent No.: US 9,128,451 B2
(45) Date of Patent: Sep. 8, 2015

(54) IMAGE FORMING APPARATUS

(71) Applicant: KYOCERA Document Solutions Inc., Osaka-shi, Osaka (JP)

(72) Inventors: Mitsuhiro Goda, Osaka (JP); Susumu Hanano, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/169,070

(22) Filed: Jan. 30, 2014

(65) Prior Publication Data

US 2014/0212193 A1 Jul. 31, 2014

(30) Foreign Application Priority Data

Jan. 31, 2013 (JP) ..... 2013-017084

(51) Int. Cl.
*G03G 21/00* (2006.01)

(52) U.S. Cl.
CPC ..... *G03G 21/0029* (2013.01)

(58) Field of Classification Search
USPC ..... 399/107, 110, 111, 113, 123, 343, 350, 399/351
See application file for complete search history.

(56) References Cited

U.S. PATENT DOCUMENTS 6,643,482 B2 * 11/2003 Higeta et al. ..... 399/109

FOREIGN PATENT DOCUMENTS

JP 2003263085 A 9/2003

* cited by examiner

*Primary Examiner* — Hoan Tran
(74) *Attorney, Agent, or Firm* — Alleman Hall McCoy Russell & Tuttle LLP

(57) ABSTRACT

An image forming apparatus includes an apparatus main body, a housing, a photosensitive drum, a cleaning blade, a contact portion, and a contacted portion. The housing and drum are disposed in an internal space of the main body. The blade is a plate-shaped elastic member extending in an axial direction of a rotational axis of the drum, is supported by the housing, and contacts a circumferential surface of the drum for cleaning. The contact portion is disposed opposite the housing in the main body. The contacted portion is disposed at a center portion, in the axial direction, of the housing and is contacted by the contact portion. A position of the center portion, in the axial direction, of the housing is adjusted in a cross section intersecting the axial direction by the housing being inserted into the internal space and the contact portion coming into contact with the contacted portion.

8 Claims, 12 Drawing Sheets

IMAGE FORMING APPARATUS

INCORPORATION BY REFERENCE

This application is based upon and claims the benefit of priority from the corresponding Japanese Patent Application No. 2013-017084 filed on Jan. 31, 2013, the entire contents of which are incorporated herein by reference.

BACKGROUND

The present disclosure relates to an image forming apparatus including a housing which supports a cleaning blade and is attachable to and detachable from an apparatus main body.

Conventionally, in an image forming apparatus, a toner image is formed on a photosensitive drum by a developing device, and the toner image is transferred onto a sheet at a transfer portion. The image forming apparatus further includes a fixing portion. The sheet on which the toner image has been transferred is subjected to a fixing process at the fixing portion and then discharged. Untransferred toner remains on the photosensitive drum from which the toner image has been transferred. Thus, a technique is known in which a cleaning blade contacts with the surface of the photosensitive drum. The cleaning blade removes the untransferred toner from the surface of the photosensitive drum.

The cleaning blade is disposed in a housing which is attachable to and detachable from an apparatus main body. In many cases, the housing integrally supports the cleaning blade and the photosensitive drum. The housing is often formed by resin molding, and there is a problem that a pressing force of the cleaning blade to the photosensitive drum partially changes due to warp of the housing after the molding. Conventionally, a technique is known in which the change of the pressing force caused due to the warp is suppressed by modifying the shape of or a fastening method for a sheet metal member which supports the cleaning blade. In addition, a technique is known in which a manner of attaching a sealing member is modified in order to prevent leak of toner collected by the cleaning blade from deteriorating due to warp of the housing.

In the above conventional techniques, when the housing has warped, it is necessary to adjust the position of the respective cleaning blade in order to uniformize the pressing force of the cleaning blade to the photosensitive drum. In addition, the pressing force changes due to part variation of the cleaning blade, environmental variation, degradation of the cleaning blade caused due to a long period of use, or the like.

SUMMARY

An image forming apparatus according to one aspect of the present disclosure includes an apparatus main body, a housing, a photosensitive drum, a cleaning blade, a contact portion, and a contacted portion. The apparatus main body has an internal space. The housing is fixed to the apparatus main body after being inserted into the internal space toward a predetermined insertion direction. The photosensitive drum has a rotational axis and a circumferential surface. The photosensitive drum is disposed in the internal space and is configured to rotate around the rotational axis and to carry a toner image on the circumferential surface. The cleaning blade is formed of a plate-shaped elastic member provided so as to extend in an axial direction of the rotational axis, is supported by the housing, and contacts with the circumferential surface of the photosensitive drum to clean the photosensitive drum. The contact portion is disposed in the apparatus main body so as to oppose the housing. The contacted portion is disposed at a center portion, in the axial direction, of the housing and is contacted with by the contact portion. In the image forming apparatus, a position of the center portion, in the axial direction, of the housing is adjusted in a cross section intersecting the axial direction by the housing being inserted into the internal space and the contact portion coming into contact with the contacted portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
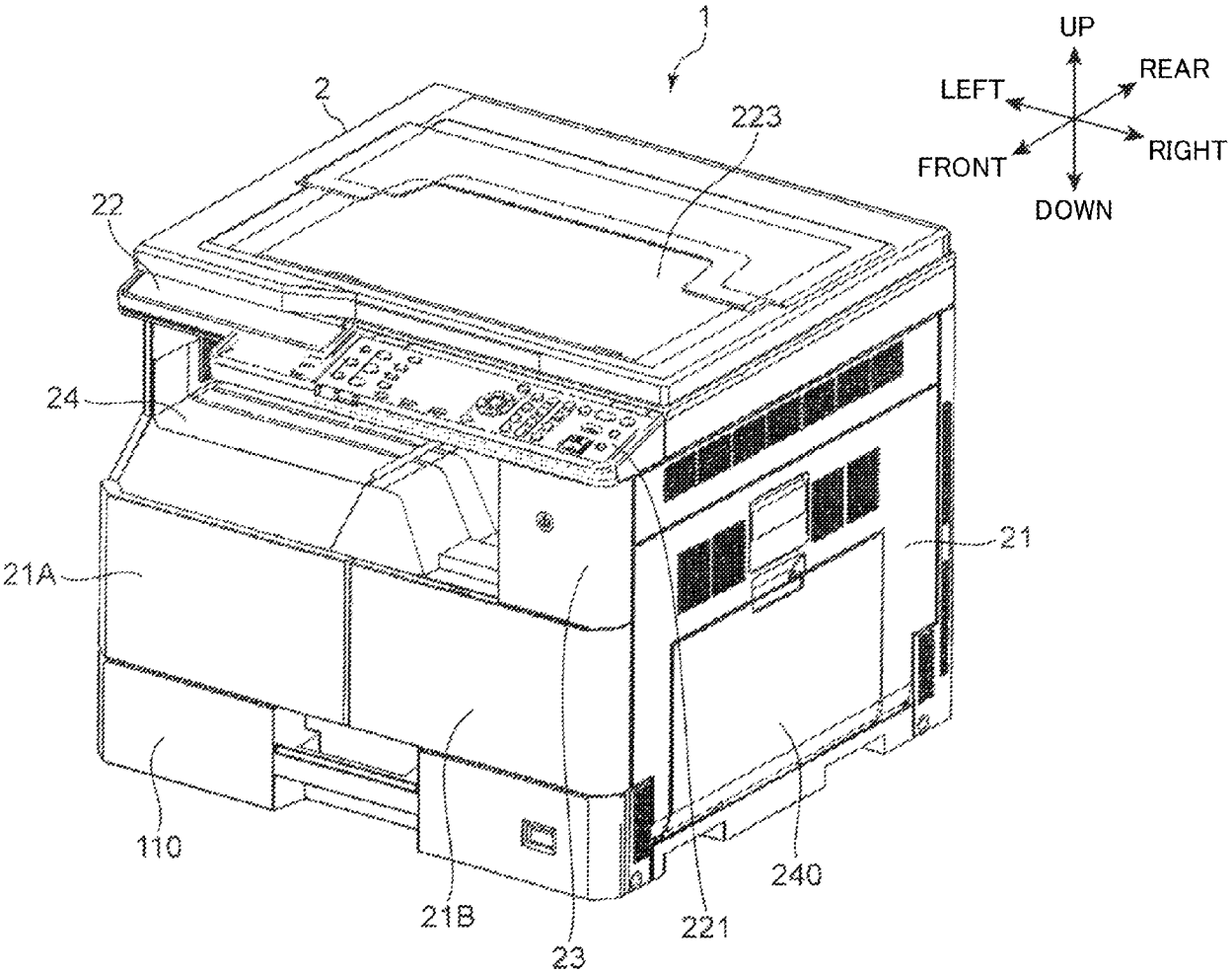
FIG. 1 is a perspective view of an image forming apparatus according to an embodiment of the present disclosure.
Figure 2:
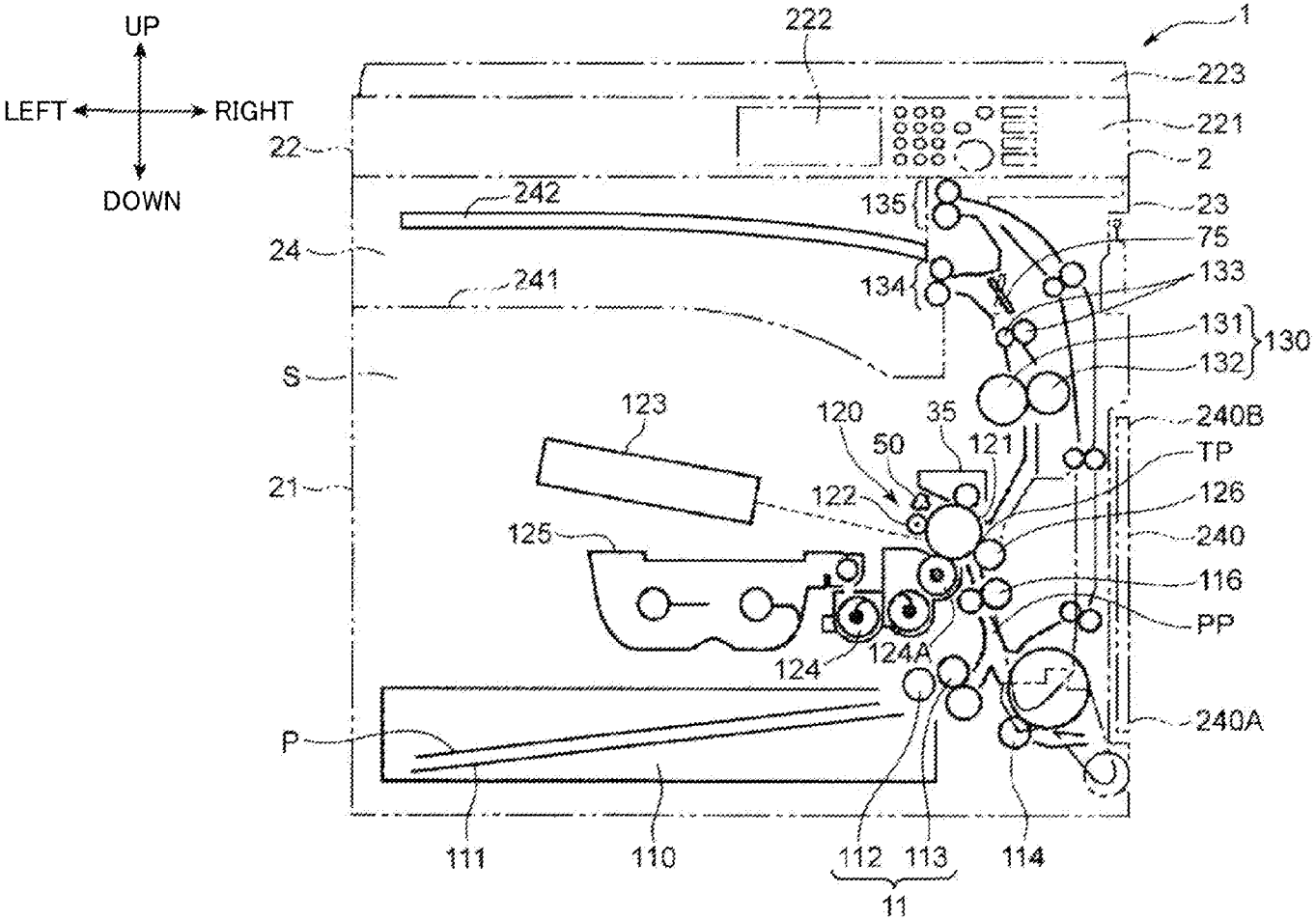
FIG. 2 is a cross-sectional view showing the internal structure of the image forming apparatus according to the embodiment of the present disclosure.

Hereinafter, an embodiment of the present disclosure will be described with reference to the drawings. An image forming apparatus 1 shown in FIGS. 1 and 2 is a so-called monochrome multifunction peripheral. However, in another embodiment, the image forming apparatus may be another apparatus which is capable of forming a toner image on a sheet, such as a color multifunction peripheral, a color printer, or a facsimile. It is noted that terms representing directions such as "up", "down", "front", "rear", "left", and "right" used in the following description are intended to merely clarify the description and are not intended to limit the principle of the image forming apparatus in any way. In addition, in the following description, the term "sheet" refers to copy paper, coated paper, OHP sheet, thick paper, postcard, tracing paper, other sheet material to be subjected to an image forming process, or sheet material to be subjected to any process other than the image forming process.

The image forming apparatus 1 includes a main housing 2 having a substantially rectangular parallelepiped shape. The main housing 2 includes a lower housing 21 (apparatus main body) having a substantially rectangular parallelepiped shape, an upper housing 22 having a substantially rectangular parallelepiped shape which is disposed above the lower housing 21, and a connection housing 23 which connects the lower housing 21 to the upper housing 22. The connection housing 23 extends along a right edge and a rear surface edge of the main housing 2. A sheet on which an image has been formed is discharged to a discharge space 24 which is surrounded by the lower housing 21, the upper housing 22, and the connection housing 23. In particular, in the present embodiment, sheets are discharged to a sheet discharge portion 241 disposed at an upper surface portion of the lower housing 21 and to a sheet discharge tray 242 (FIG. 2) disposed above the sheet discharge portion 241.

An operation portion 221 disposed in a front surface direction of the upper housing 22 includes, for example, an LCD touch panel 222. The operation portion 221 is formed so as to allow input of information regarding an image forming process. A user is allowed to, for example, input the number of sheets to be printed or the like or input a printing density or the like through the LCD touch panel 222. Within the upper housing 22, a device which is capable of reading an image on a document and an electronic circuit which controls the entirety of the image forming apparatus 1 are mainly housed.

A pressing cover 223 disposed on the upper housing 22 is used for pressing a document. The pressing cover 223 is mounted on the upper housing 22 so as to be rotatable upward and downward. The user rotates the pressing cover 223 upward, and places a document on the upper housing 22. Then, the user is allowed to operate the operation portion 221 to cause the device provided within the upper housing 22 to read an image on the document.

The lower housing 21 includes a left cover 21A and a right cover 21B. The left cover 21A and the right cover 21B form a part of a front wall portion of the lower housing 21. The left cover 21A is disposed below the discharge space 24 and at the left side. The right cover 21B is disposed below the discharge space 24 and the connection housing 23. The left cover 21A and the right cover 21B are cover members which are attachable to and detachable from the lower housing 21. In a state where the right cover 21B is detached from the lower housing 21, a later-described drum unit 31H is attached to or detached from the lower housing 21 in a front-rear direction.

A manual feed tray 240 is disposed at a right side surface of the lower housing 21. The manual feed tray 240 is rotatable at an upper end 240B side around a lower end 240A upward and downward. When the manual feed tray 240 is rotated downward and located in such a position as to protrude rightward from the lower housing 21, the user is allowed to place sheets on the manual feed tray 240. On the basis of an instruction inputted by the user through the operation portion 221, the sheet on the manual feed tray 240 is drawn into the lower housing 21, then subjected to an image forming process, and discharged to the discharge space 24. In addition, an internal space S in which various devices described later are disposed is formed within the lower housing 21 (FIG. 2).

The image forming apparatus 1 includes a cassette 110, a sheet feed portion 11, a second sheet feed roller 114, a registration roller pair 116, and an image forming portion 120 within the internal space S. The sheet feed portion 11 includes a pickup roller 112 and a first sheet feed roller 113. The sheet feed portion 11 feeds a sheet P to a sheet conveyance path PP. The sheet conveyance path PP is a conveyance path provided so as to go from the sheet feed portion 11 through the registration roller pair 116 and pass through a transfer position TP located within the image forming portion 120.

The cassette 110 contains sheets P therein. The cassette 110 is capable of being drawn from the lower housing 21 in the front surface direction (front direction). The sheet P contained in the cassette 110 is fed upward within the lower housing 21. Then, on the basis of an instruction inputted by the user through the operation portion 221, the sheet P is subjected to an image forming process within the lower housing 21, and is discharged to the discharge space 24. The cassette 110 includes a lift plate 111 which supports the sheets P. The lift plate 111 is tilted so as to push up leading edges of the sheets P.

The pickup roller 112 is disposed on the leading edges of the sheets P pushed up by the lift plate 111. When the pickup roller 112 rotates, the sheet P is drawn out from the cassette 110.

The first sheet feed roller 113 is disposed at the downstream side of the pickup roller 112 in a sheet conveyance direction. The first sheet feed roller 113 feeds the sheet P to the further downstream side in the sheet conveyance direction. The second sheet feed roller 114 is disposed inward of the lower end 240A of the manual feed tray 240. The second sheet feed roller 114 conveys a sheet P on the manual feed tray 240 into the lower housing 21. The user is allowed to selectively use the sheets P contained in the cassette 110 or the sheets P placed on the manual feed tray 240.

The registration roller pair 116 defines the position of the sheet in a direction orthogonal to the sheet conveyance direction. Thus, the position of an image to be formed on the sheet P is adjusted. A nip portion is formed between rollers of the registration roller pair 116. The registration roller pair 116 conveys the sheet P to the image forming portion 120 at a timing when a toner image is transferred onto the sheet P at the image forming portion 120. In addition, the registration roller pair 116 has a function to correct diagonal feeding (skewing) of the sheet P.

The image forming portion 120 includes a photosensitive drum 121, a charging device 122, an exposure device 123, a developing device 124, a toner container 125, a transfer roller 126, a cleaning device 35, and a charge removing device 50. It is noted that the photosensitive drum 121, the charging device 122, the cleaning device 35, and the charge removing device 50 are integrally disposed in the later-described drum unit 31H.

The photosensitive drum 121 has a cylindrical shape. An electrostatic latent image is formed on the circumferential surface of the photosensitive drum 121, and a toner image corresponding to the electrostatic latent image is carried on the photosensitive drum 121.

A predetermined voltage is applied to the charging device 122, and the charging device 122 substantially uniformly charges the circumferential surface of the photosensitive drum 121. The exposure device 123 applies laser light to the circumferential surface of the photosensitive drum 121 which has been charged by the charging device 122. The laser light is applied in accordance with image data outputted from an external apparatus (not shown) such as a personal computer connected to the image forming apparatus 1 in a communicable manner. As a result, an electrostatic latent image corresponding to the image data is formed on the circumferential surface of the photosensitive drum 121.

The developing device 124 supplies toner to the circumferential surface of the photosensitive drum 121 on which the electrostatic latent image has been formed. The toner container 125 supplies the toner to the developing device 124. The toner container 125 supplies the toner to the developing device 124 sequentially or according to needs. When the developing device 124 supplies the toner to the photosensitive drum 121, the electrostatic latent image formed on the circumferential surface of the photosensitive drum 121 is developed (visualized). As a result, a toner image is formed on the circumferential surface of the photosensitive drum 121. The developing device 124 includes a developing roller 124A which carries the toner on a circumferential surface thereof. The developing roller 124A is disposed at a developing position so as to oppose the photosensitive drum 121. The developing roller 124A is rotationally driven to supply the toner to the photosensitive drum 121.

The transfer roller 126 is disposed at the transfer position TP so as to oppose the circumferential surface of the photosensitive drum 121. The transfer roller 126 is rotationally driven at the transfer position TP in the same direction as the photosensitive drum 121. At the transfer position TP, the toner image formed on the circumferential surface of the photosensitive drum 121 is transferred onto the sheet P.

After the toner image is transferred onto the sheet P, the cleaning device 35 removes the toner remaining on the circumferential surface of the photosensitive drum 121. The charge removing device 50 applies predetermined charge removing light to the photosensitive drum 121 whose circumferential surface has been cleaned by the cleaning device 35. As a result, the potential of the circumferential surface of the photosensitive drum 121 is uniformized.

The circumferential surface of the photosensitive drum 121 which has been subjected to the charge removal by the charge removing device 50 after being cleaned by the cleaning device 35 passes below the charging device 122 again and is charged uniformly. Then, the above toner image formation is newly performed thereon.

The image forming apparatus 1 further includes, at the downstream side of the image forming portion 120 in the conveyance direction, a fixing device 130 which fixes the toner image on the sheet P. The fixing device 130 includes a heating roller 131 which melts the toner on the sheet P, and a pressure roller 132 which brings the sheet P into close contact with the heating roller 131. When the sheet P passes between the heating roller 131 and the pressure roller 132, the toner image is fixed on the sheet P.

The image forming apparatus 1 further includes a conveying roller pair 133 disposed downstream of the fixing device 130, a switching portion 75 disposed downstream of the conveying roller pair 133, lower discharge rollers 134, and upper discharge rollers 135. The conveying roller pair 133 conveys the sheet P subjected to the fixing process by the fixing device 130, to the downstream side in the sheet conveyance direction. The switching portion 75 has a function to switch the conveyance direction of the sheet P at the downstream side of the conveying roller pair 133 in the sheet conveyance direction. The lower discharge rollers 134 are disposed to the left of the switching portion 75 and discharge the sheet P conveyed by the conveying roller pair 133, to the sheet discharge portion 241. The upper discharge rollers 135 are disposed above the lower discharge rollers 134 and discharge the sheet P conveyed by the conveying roller pair 133, to the sheet discharge tray 242 mounted above the sheet discharge portion 241.

Next, the structure of the drum unit 31H according to a first embodiment of the present disclosure will be described with reference to FIGS. 3 to 6. The drum unit 31H is mounted in the lower housing 21 having the internal space S. The drum unit 31H is inserted toward the internal space S in the direction of an arrow D41 in FIG. 4 (an insertion direction), and then fixed to the lower housing 21. In the present embodiment, the insertion direction of the drum unit 31H is a direction along the axial direction of a rotational axis 121A of the later-described photosensitive drum 121.

Figure 3:
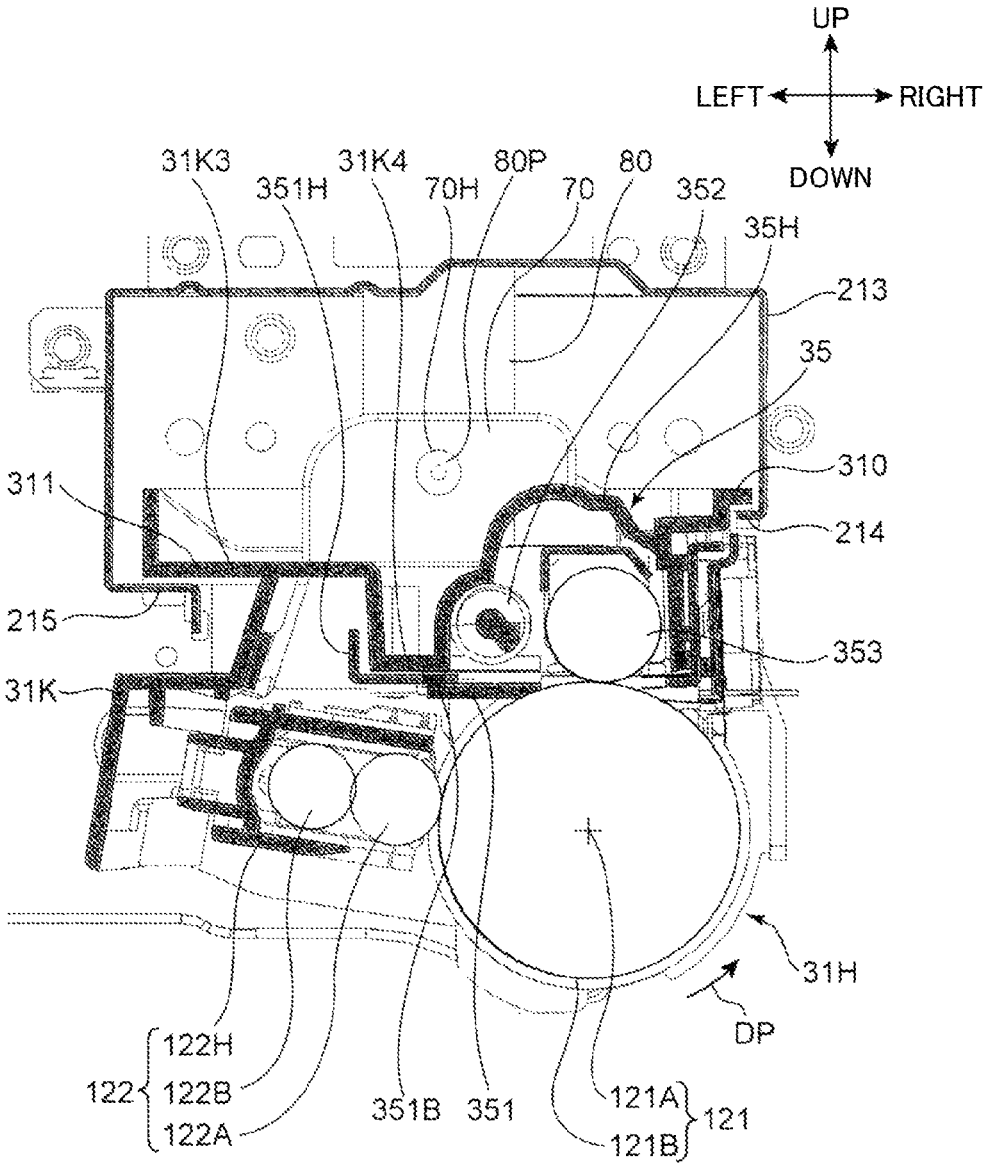
FIG. 3 is a cross-sectional view of the vicinity of a drum unit according to an embodiment of the present disclosure.
Figure 4:
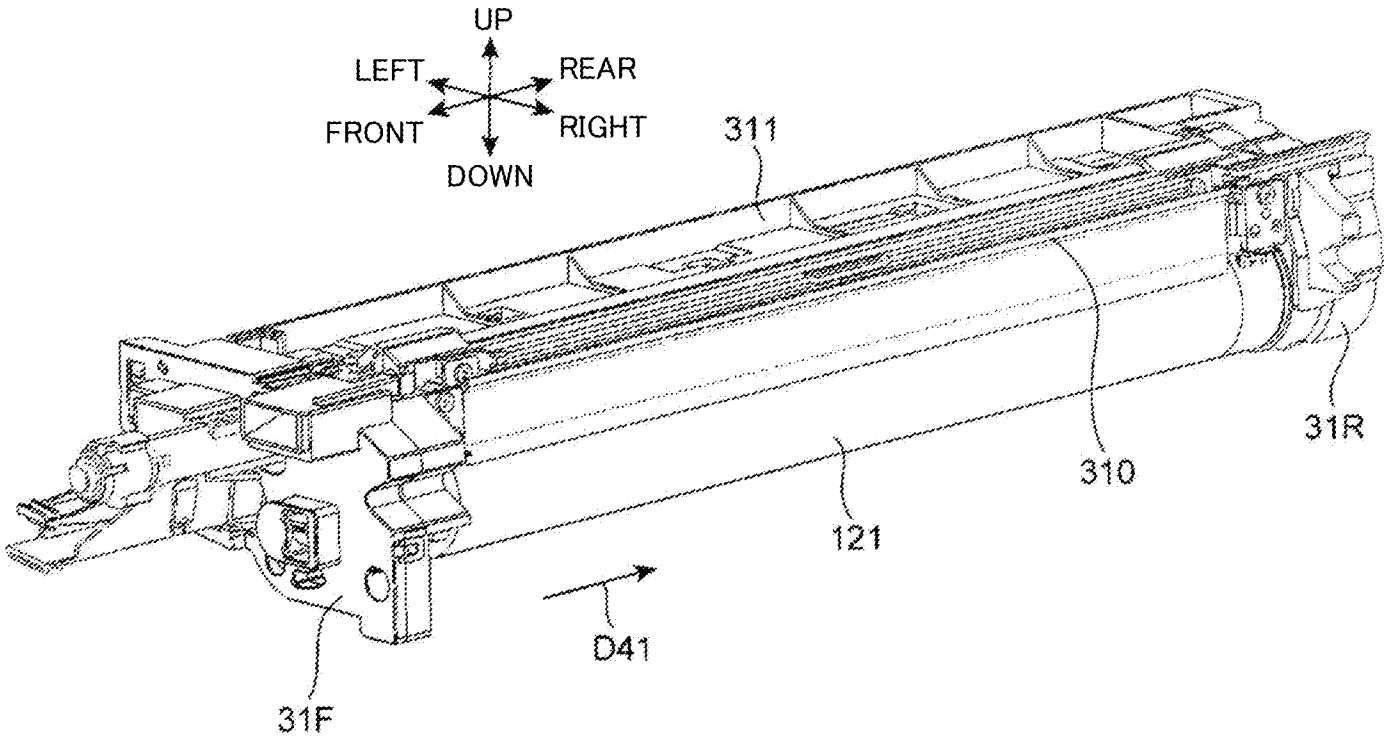
FIG. 4 is a perspective view of the drum unit according to the embodiment of the present disclosure.
Figure 5:
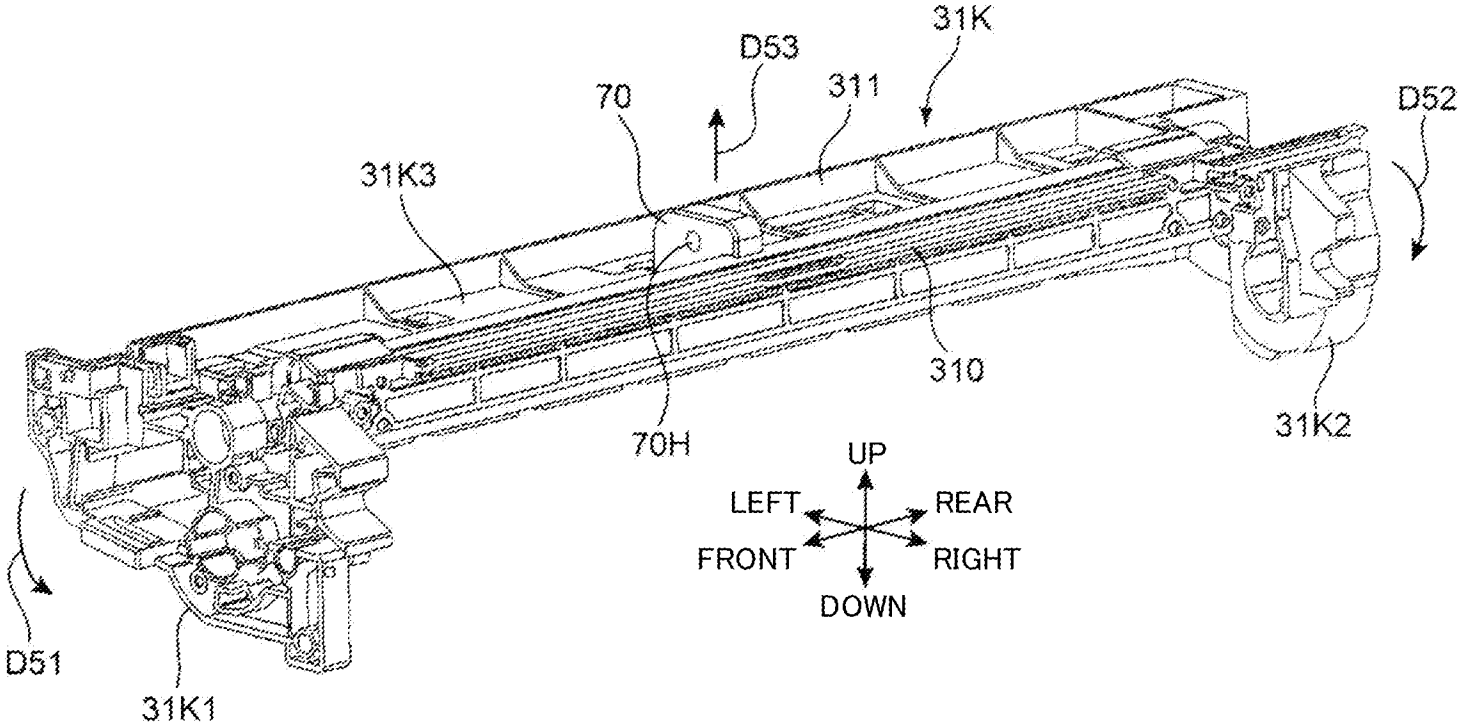
FIG. 5 is a perspective view of a housing of the drum unit according to the embodiment of the present disclosure.
Figure 6:
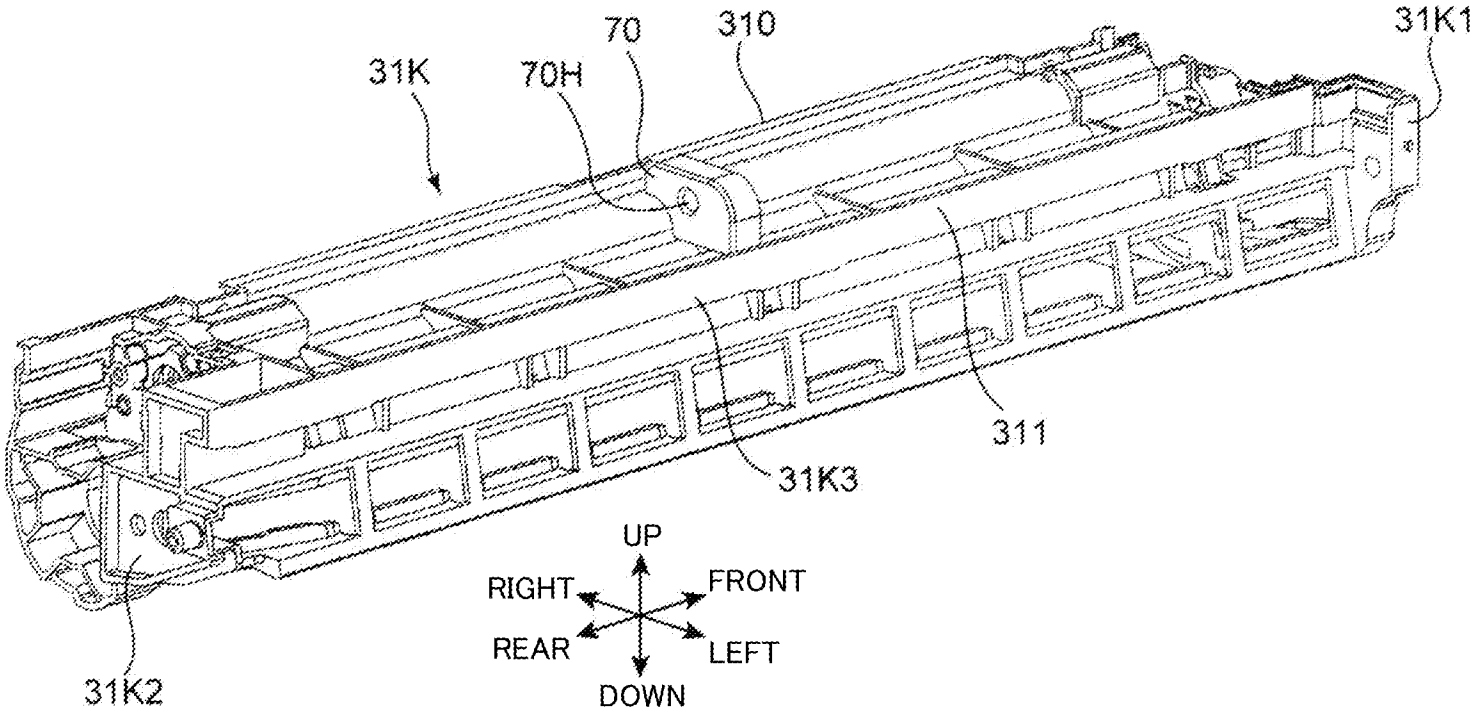
FIG. 6 is a perspective view of the housing of the drum unit according to the embodiment of the present disclosure.

As described above, the drum unit 31H includes the photosensitive drum 121, the charging device 122, and the cleaning device 35 (FIG. 3). In addition, the drum unit 31H includes a unit front wall 31F and a unit rear wall 31R at both end portions in the front-rear direction. The unit front wall 31F and the unit rear wall 31R are a pair of wall portions facing in the front-rear direction, of the drum unit 31H. The unit front wall 31F is provided in a standing manner at the upstream side (rear end side) of the drum unit 31H in the insertion direction. The unit front wall 31F and the unit rear wall 31R are disposed at a predetermined interval therebetween in the front-rear direction. The drum unit 31H includes fixed portions (not shown) disposed in the unit front wall 31F and the unit rear wall 31R. When the drum unit 31H is mounted in the lower housing 21 of the image forming apparatus 1, the fixed portions are fixed to a later-described frame 210 of the image forming apparatus 1. As a result, in the image forming apparatus 1, the position of the drum unit 31H is fixed. Each of the fixed portions is composed of a hole for fastening into which a screw is fastened, or the like.

The drum unit 31H includes a unit housing 31K (FIGS. 5 and 6) (housing). The unit housing 31K is a framework of the drum unit 31H. The unit housing 31K is made of a resin material. In the present embodiment, the unit housing 31K is formed by molding with a mold. The unit housing 31K includes a housing front surface portion 31K1 (side wall), a housing rear surface portion 31K2 (side wall), and a housing connection portion 31K3 (connection wall). The housing front surface portion 31K1 and the housing rear surface portion 31K2 are a pair of side walls which are provided in a standing manner in the drum unit 31H and at both end portions in the axial direction of the rotational axis 121A of the photosensitive drum 121. In addition, the housing connection portion 31K3 connects the housing front surface portion 31K1 to the housing rear surface portion 31K2 in the axial direction. Referring to FIG. 3, the housing connection portion 31K3 mainly connects the housing front surface portion 31K1 to the housing rear surface portion 31K2 at an upper portion and a left portion of the drum unit 31H. By mounting a cover member, which is not shown, around the unit housing 31K, the appearance of the drum unit 31H is formed. In addition, the photosensitive drum 121 is rotatably supported by the unit housing 31K. Moreover, the charging device 122, the cleaning device 35, and the charge removing device 50 are supported by the unit housing 31K so as to oppose the photosensitive drum 121.

Referring to FIG. 3, the photosensitive drum 121 has the rotational axis 121A and a cylindrical surface 121B which rotates around the rotational axis 121A. An electrostatic latent image is formed on the cylindrical surface 121B, and a toner image corresponding to the electrostatic latent image is carried on the cylindrical surface 121B. A photosensitive drum using an amorphous silicon (a-Si) based material can be used as the photosensitive drum 121.

The charging device 122 is disposed to the left of the photosensitive drum 121. The charging device 122 includes a charging roller 122A, a cleaning roller 122B, and a charging housing 122H. The charging housing 122H has a substantially U shape in a cross-sectional view orthogonal to the rotational axis 121A of the photosensitive drum 121. Each of the charging roller 122A and the cleaning roller 122B is rotatably supported within the charging housing 122H.

The charging roller 122A is a roll member whose surface is made of a rubber material. A charging voltage is applied from a bias application means which is not shown, to the charging roller 122A. The charging roller 122A is rotated so as to follow the photosensitive drum 121 by contacting with the cylindrical surface 121B of the photosensitive drum 121. The cylindrical surface 121B of the photosensitive drum 121 is uniformly charged by the charging roller 122A to which the charging voltage has been applied.

The cleaning roller 122B contacts with the charging roller 122A and rotates with a linear velocity difference with respect to the charging roller 122A. The cleaning roller 122B is a brush roller formed from a conductive nylon fiber. By the charging roller 122A contacting with the cylindrical surface 121B of the photosensitive drum 121, toner, foreign matter, or the like is attached to the surface of the charging roller 122A. By the cleaning roller 122B being rotated with the linear velocity difference while being in contact with the charging roller 122A, the toner, the foreign matter, or the like attached to the surface of the charging roller 122A is favorably removed.

The cleaning device 35 is disposed above the photosensitive drum 121. The cleaning device 35 includes a cleaner housing 35H, a cleaning blade 351, a conveyance screw 352, and a polishing roller 353.

The cleaner housing 35H is a housing which supports each member within the cleaning device 35. The cleaning device 35 is disposed so as to cover above the photosensitive drum 121 and a part of the charging device 122. In particular, a left portion of the cleaner housing 35H is disposed above the charging roller 122A. In addition, a center portion, in the right-left direction, of the cleaner housing 35H has an arc shape projecting upward in a cross-sectional view orthogonal to the rotational axis 121A of the photosensitive drum 121. The cleaner housing 35H forms a part of the housing connection portion 31K3 of the unit housing 31K.

The cleaning blade 351 is horizontally disposed along a bottom portion of the cleaner housing 35H. In addition, the cleaning blade 351 is provided so as to extend in the axial direction of the rotational axis 121A of the photosensitive drum 121. The cleaning blade 351 is a plate-shaped elastic member made of a rubber material. The cleaning blade 351 contacts with the cylindrical surface 121B of the photosensitive drum 121 to clean the photosensitive drum 121. The cleaning blade 351 is supported by a blade holder 351H. The blade holder 351H is a sheet metal member having an L shape in the above cross-sectional view. The blade holder 351H is fixed to the cleaner housing 35H (the housing connection portion 31K3) by a blade fastening portion 351B. In this case, the blade holder 351H is fastened to a housing recess portion 31K4 which is partially recessed downward in the housing connection portion 31K3. In addition, the cleaning blade 351 and the blade holder 351H are fixed to each other by an adhesive. As a result, a fixed end of the cleaning blade 351 is formed. On the other hand, a distal end of the cleaning blade 351 is a free end and is brought into contact with the cylindrical surface 121B of the photosensitive drum 121. The distal end of the cleaning blade 351 contacts with the cylindrical surface 121B at the downstream side of the later-described polishing roller 353 in a rotation direction of the photosensitive drum 121 (an arrow DP direction). As a result, toner remaining (attached) on the cylindrical surface 121B of the photosensitive drum 121 is removed by the distal end of the cleaning blade 351.

The conveyance screw 352 is rotatably supported by the cleaner housing 35H above the cleaning blade 351. The conveyance screw 352 includes a shaft portion and a spiral blade member disposed around the shaft portion. The conveyance screw 352 conveys collected toner which is scraped by the cleaning blade 351 and accumulated on the cleaning blade 351, in the axial direction of the rotational axis 121A of the photosensitive drum 121.

The polishing roller 353 is disposed to the right of the conveyance screw 352. The polishing roller 353 has a rotation surface which contacts with the cylindrical surface 121B above the rotational axis 121A of the photosensitive drum 121. The polishing roller 353 is a rubber roller whose circumferential surface is subjected to roughening treatment, and a roller in which an EPDM rubber (ethylene-propylene rubber) having a thickness of 1.75 mm is provided on a shaft having a diameter of 12 mm is used as the polishing roller 353 in the present embodiment. The polishing roller 353 is rotated so as to follow the photosensitive drum 121 while being in contact with the cylindrical surface 121B of the photosensitive drum 121. The polishing roller 353 collects toner attached to the cylindrical surface 121B of the photosensitive drum 121. In addition, the polishing roller 353 abrades attached matter such as discharge products attached to the cylindrical surface 121B of the photosensitive drum 121. In this case, by a given amount of toner being attached to the rotation surface of the polishing roller 353, the performance of removing (the performance of abrading) the discharge products is enhanced.

Furthermore, the drum unit 31H includes a right insertion piece 310 and a left insertion piece 311. The right insertion piece 310 and the left insertion piece 311 are plate-shaped members provided so as to extend from the unit front wall 31F to the unit rear wall 31R above the drum unit 31H. In addition, each of the right insertion piece 310 and the left insertion piece 311 forms a part of the housing connection portion 31K3. The right insertion piece 310 and the left insertion piece 311 are disposed at an interval therebetween in the right-left direction. Referring to FIG. 3, in a cross-sectional view intersecting the rotational axis 121A of the photosensitive drum 121, the right insertion piece 310 is provided so as to project rightward. In addition, the left insertion piece 311 is provided so as to project leftward. The right insertion piece 310 and the left insertion piece 311 have a function to guide the drum unit 31H when the drum unit 31H is mounted in the lower housing 21.

Furthermore, the drum unit 31H includes a standing wall 70 (contacted portion). The standing wall 70 is a wall portion provided in a standing manner on the unit housing 31K of the drum unit 31H. Specifically, the standing wall 70 is disposed on a center portion, in the axial direction of the rotational axis 121A, of the housing connection portion 31K3. The standing wall 70 has a predetermined width in the front-rear direction and is provided so as to project upward from the housing connection portion 31K3. The standing wall 70 has a hole 70H (positioning hole). The hole 70H is an open hole formed so as to extend through the standing wall 70 in the front-rear direction. By the hole 70H, an inner circumferential surface which is not shown is formed in the standing wall 70. A later-described corrective pin 80P is inserted through the hole 70H. In other words, the corrective pin 80P contacts with the standing wall 70. Specifically, the outer circumferential surface of the corrective pin 80P contacts with the inner circumferential surface of the standing wall 70.

Figure 7:
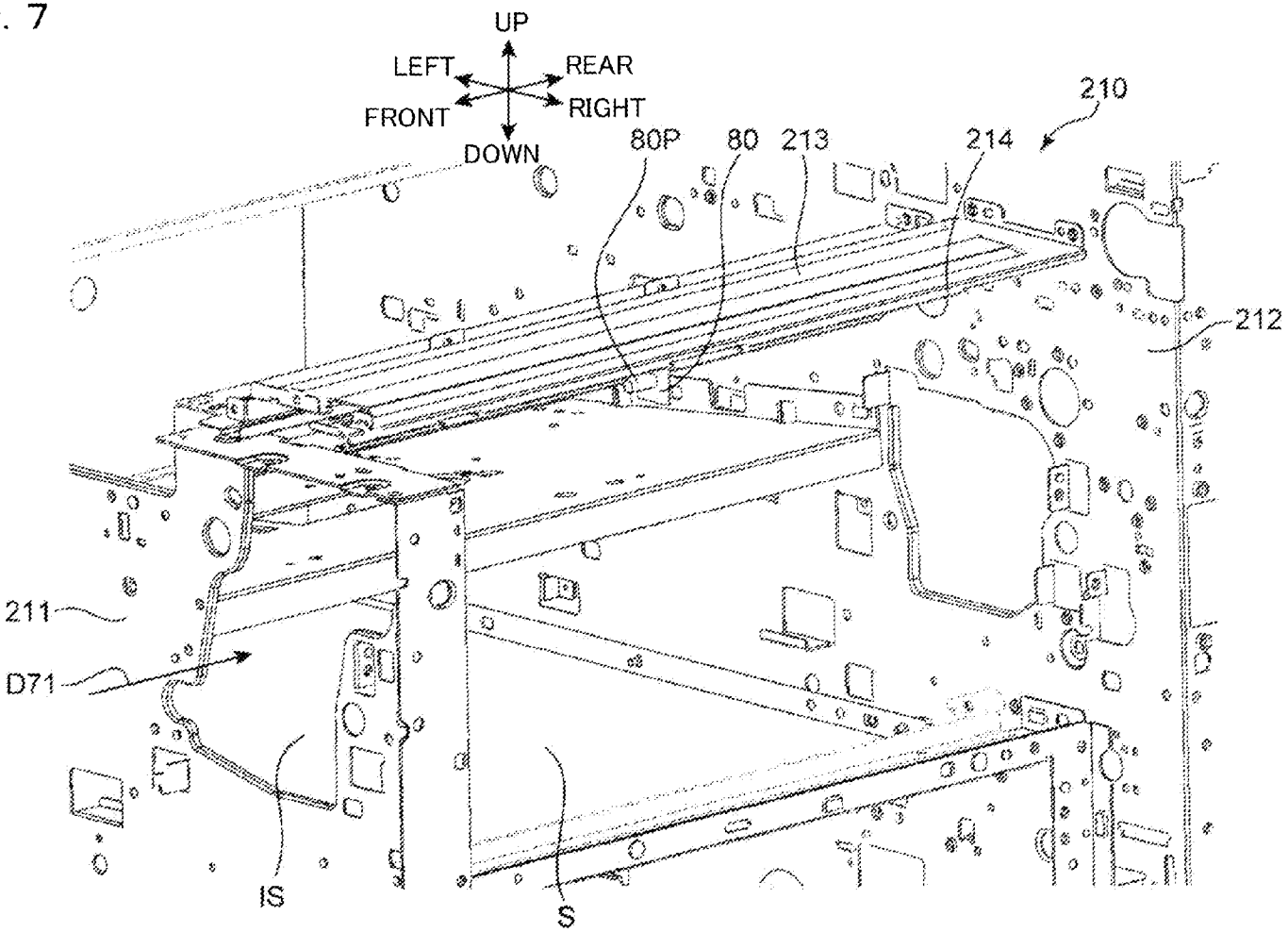
FIG. 7 is a perspective view of a frame of a lower housing according to the embodiment of the present disclosure.
Figure 8:
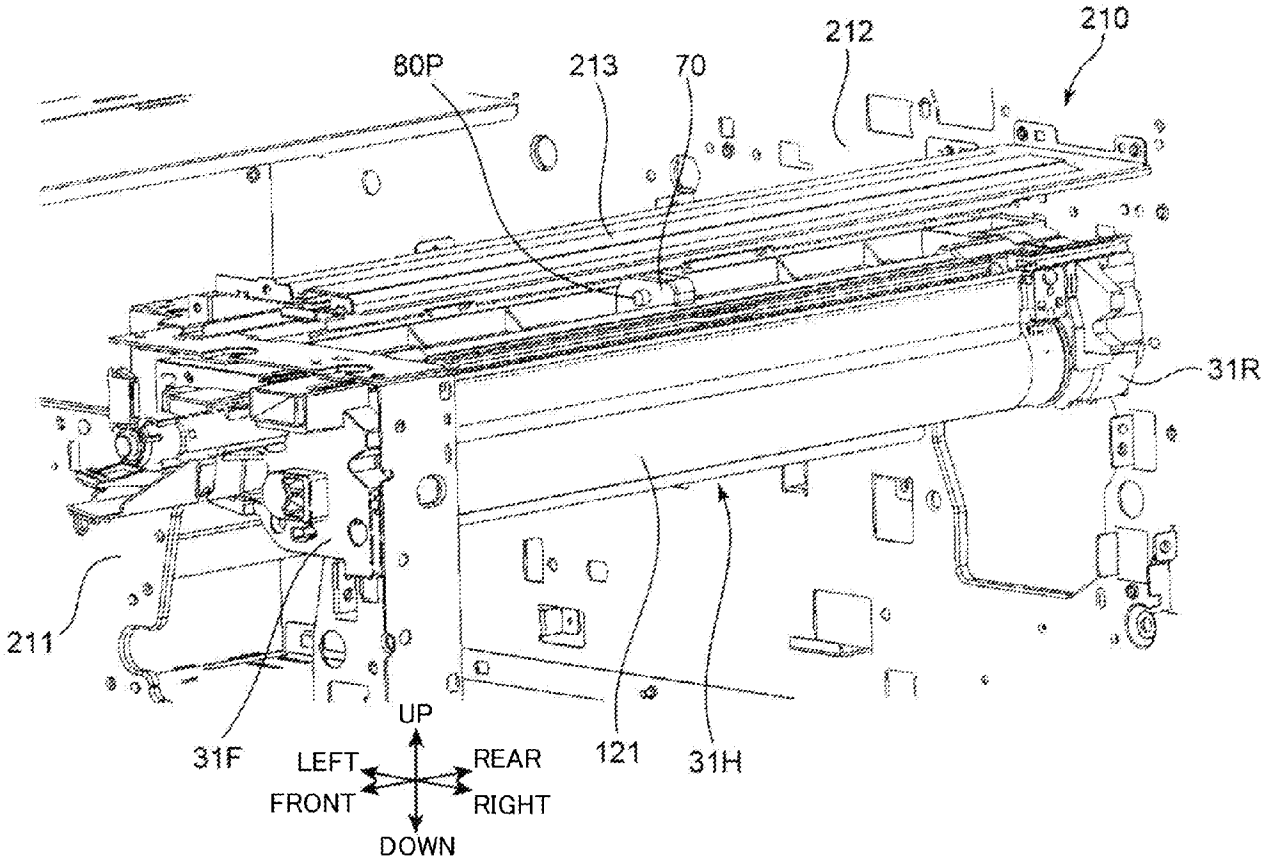
FIG. 8 is a perspective view of a state where the drum unit is mounted in the lower housing according to the embodiment of the present disclosure.

Next, a mode in which the drum unit 31H is mounted in the internal space S of the lower housing 21 will be described in detail with reference to FIGS. 7 and 8 in addition to FIGS. 3 to 6. FIG. 7 is a perspective view showing an insertion space IS, in the lower housing 21, into which the drum unit 31H is inserted. FIG. 7 is a diagram showing the frame 210 forming a part of the lower housing 21. In addition, FIG. 8 is a perspective view of a state where the drum unit 31H is mounted in the lower housing 21.

Referring to FIG. 7, the lower housing 21 includes the frame 210. The frame 210 is a framework of the lower housing 21. The frame 210 is formed of a metal frame. The frame 210 includes a front frame 211, a rear frame 212, and a connection frame 213. The front frame 211 is a frame portion defining a front portion of the frame 210. The front frame 211 is disposed inside the left cover 21A and the right cover 21B in FIG. 1. The rear frame 212 is a frame portion defining a rear portion of the frame 210. The rear frame 212 is disposed at a rear portion of the lower housing 21. The connection frame 213 is a frame portion connecting the front frame 211 to the rear frame 212 in the front-rear direction at a right portion and an upper portion of the frame 210. In a region of the front frame 211 which region is located below the connection frame 213, an opening is formed as shown in FIG. 7. By the opening, the insertion space IS is formed which communicates with the internal space S and through which the drum unit 31H is inserted.

Referring to FIG. 3, the connection frame 213 includes a right rail portion 214 and a left rail portion 215. The right rail portion 214 and the left rail portion 215 are provided so as to extend in the front-rear direction at end portions, in the right-left direction, of the connection frame 213. Above the right rail portion 214, the right insertion piece 310 of the drum unit 31H is engaged therewith. In addition, above the left rail portion 215, the left insertion piece 311 of the drum unit 31H is engaged therewith. The right rail portion 214 and the left rail portion 215 guide insertion of the drum unit 31H into the insertion space IS.

Furthermore, referring to FIG. 7, the connection frame 213 includes a support plate 80 and the corrective pin 80P (contact portion). The support plate 80 is disposed at a center portion, in the axial direction of the rotational axis 121A of the photosensitive drum 121, of the internal space S so as to oppose the drum unit 31H. The support plate 80 is a plate-shaped member provided so as to project downward from the connection frame 213. The support plate 80 is disposed so as to face in the front-rear direction. The corrective pin 80P is a pin-shaped member provided so as to extend in the axial direction (front direction) from the support plate 80. The corrective pin 80P is formed in a cylindrical shape and has an outer circumferential surface. In the present embodiment, each of the support plate 80 and the corrective pin 80P is made of a metallic material. The corrective pin 80P has a function to come into contact with the standing wall 70 of the drum unit 31H. Specifically, the corrective pin 80P comes into contact with the inner circumferential surface formed by the hole 70H of the standing wall 70.

The drum unit 31H is inserted into the insertion space IS at the internal space S of the lower housing 21 (an arrow D71 in FIG. 7) while the right insertion piece 310 and the left insertion piece 311 of the drum unit 31H are engaged with the right rail portion 214 and the left rail portion 215 of the lower housing 21 as described above. Then, when the unit rear wall 31R of the drum unit 31H comes close to the rear frame 212 of the frame 210, the corrective pin 80P is inserted into the hole 70H of the standing wall 70. After a while, the drum unit 31H is completely inserted into the insertion space IS, and the drum unit 31H is fixed to the lower housing 21. At that time, the outer circumferential surface of the corrective pin 80P comes into contact with the inner circumferential surface of the standing wall 70. Specifically, the standing wall 70 is fixed by the corrective pin 80P in a direction perpendicular to the rotational axis 121A. As described above, the standing wall 70 is provided so as to project upward from the housing connection portion 31K3. The blade holder 351H which supports the cleaning blade 351 is fixed to the housing recess portion 31K4 of the housing connection portion 31K3. Thus, by the corrective pin 80P fixing the standing wall 70 in the direction perpendicular to the rotational axis 121A, a center portion, in the axial direction (front-rear direction), of the blade holder 351H is fixed in the direction perpendicular to the rotational axis 121A. It is noted that in the present embodiment, the standing wall 70 does not need to be disposed at the center of the housing connection portion 31K3 at which the housing connection portion 31K3 is divided equally in half in the axial direction of the rotational axis 121A, and may be disposed near the center, namely, at the center portion in the axial direction of the rotational axis 121A and in such a position as to allow insertion of the corrective pin 80P.

As described above, the unit housing 31K is made of a resin material. Thus, due to shrinkage of the resin after the molding with the mold, or the like, the unit housing 31K may warp such that the housing front surface portion 31K1 and the housing rear surface portion 31K2 of the unit housing 31K curve inwardly as indicated by arrows D51 and D52 in FIG. 5 and the center portion, in the axial direction, of the housing connection portion 31K3 deforms upward. In this case, a center portion, in the axial direction, of the cleaning blade 351 which is supported within the unit housing 31K is moved upward, and a pressing force of the cleaning blade 351 to the cylindrical surface 121B of the photosensitive drum 121 is decreased. As a result, a problem such as poor cleaning may arise at the center portion of the cleaning blade 351.

Even in such a case, according to the present embodiment, the standing wall 70 is pressed downward by the corrective pin 80P as described above so that the center portion, in the axial direction, of the blade holder 351H which supports the cleaning blade 351 is moved downward. As a result, the pressing force of the cleaning blade 351 to the photosensitive drum 121 is stably kept.

As described above, according to the present embodiment, by the drum unit 31H being inserted into the internal space S and the corrective pin 80P coming into contact with the standing wall 70, the position of the center portion, in the axial direction, of the unit housing 31K of the drum unit 31H is adjusted in a cross section intersecting the axial direction. Specifically, the position of the center portion of the unit housing 31K is adjusted by the corrective pin 80P such that the pressing force of the cleaning blade 351 at the center portion, in the axial direction, of the cleaning blade 351 to the photosensitive drum 121 is close to the pressing force of the cleaning blade 351 at each of both end portions, in the axial direction, of the cleaning blade 351. In particular, the rigidity of the corrective pin 80P made of a metallic material assuredly realizes the adjustment of the position of the center portion of the drum unit 31H.

Figure 9:
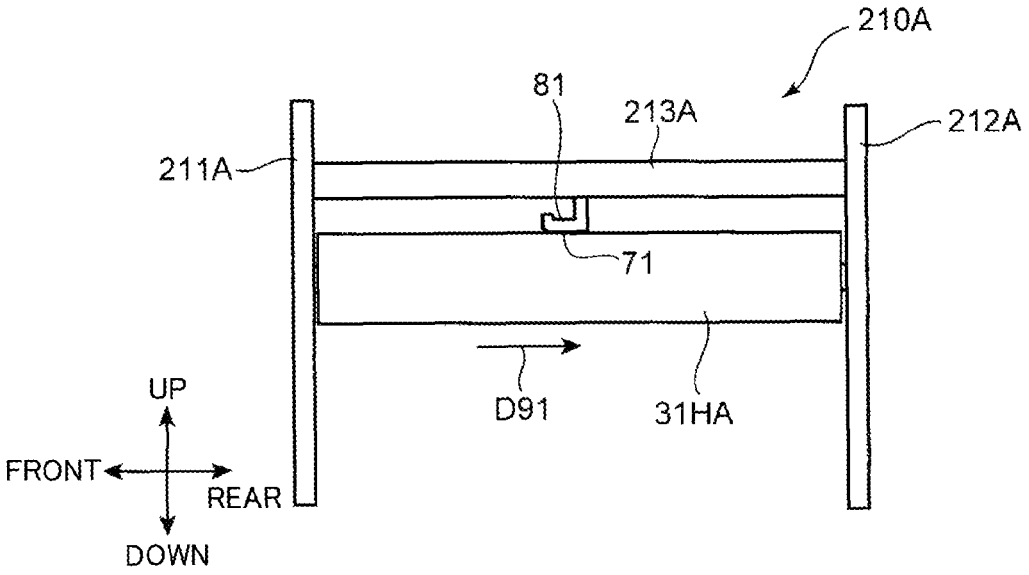
FIG. 9 is a side view of a state where a drum unit is mounted in a lower housing in another embodiment of the present disclosure.

Next, a second embodiment of the present disclosure will be described. FIG. 9 is a schematic side view of a state where a drum unit 31HA according to the present embodiment is mounted on a frame 210A. It is noted that the present embodiment differs from the above first embodiment in the configurations of the contact portion and the contacted portion, and thus only the difference will be described and the description of the other portion is omitted.

Also in the present embodiment, the frame 210A includes a pair of a front frame 211A and a rear frame 212A which are provided in a standing manner so as to extend in the front-rear direction. In addition, the front frame 211A and the rear frame 212A are connected to each other in the front-rear direction by a connection frame 213A. The drum unit 31HA is inserted along the connection frame 213A in the direction of an arrow D91 in FIG. 9, and is mounted on the frame 210A. In the present embodiment, a contact wall portion 81 (contact portion) is disposed in corresponding relation to the corrective pin 80P in the above first embodiment. The contact wall portion 81 is a wall portion provided so as to project downward from a center portion, in the axial direction, of the connection frame 213A. In the present embodiment, after the contact wall portion 81 is provided so as to project downward from the connection frame 213A, the contact wall portion 81 is bent frontward. When the drum unit 31HA is mounted on the frame 210A, a lower end portion of the contact wall portion 81 comes into contact with a contacted outer wall portion 71 (contacted portion, outer wall) of the drum unit 31HA. The contacted outer wall portion 71 is an upper outer wall at a center portion, in the axial direction (front-rear direction), of the drum unit 31HA. Also in the present embodiment, when the center portion of the drum unit 31HA warps upward, the contact wall portion 81 presses the contacted outer wall portion 71 downward, whereby a center portion of a cleaning blade which is not shown and is disposed within the drum unit 31HA is pressed toward a photosensitive drum. As a result, a pressing force of the cleaning blade is kept uniform along the axial direction. In addition, it is possible to adjust the position of the center portion, in the axial direction, of the drum unit 31HA by using the outer wall of the drum unit 31HA.

Figure 10:
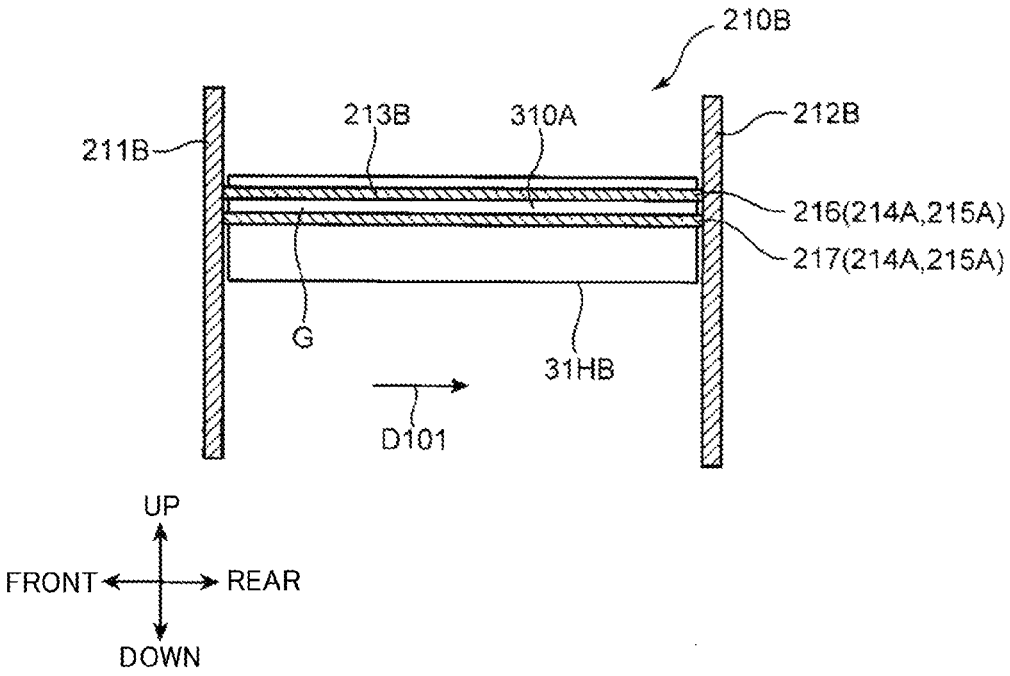
FIG. 10 is a side view of a state where a drum unit is mounted in a lower housing in another embodiment of the present disclosure.
Figure 11:
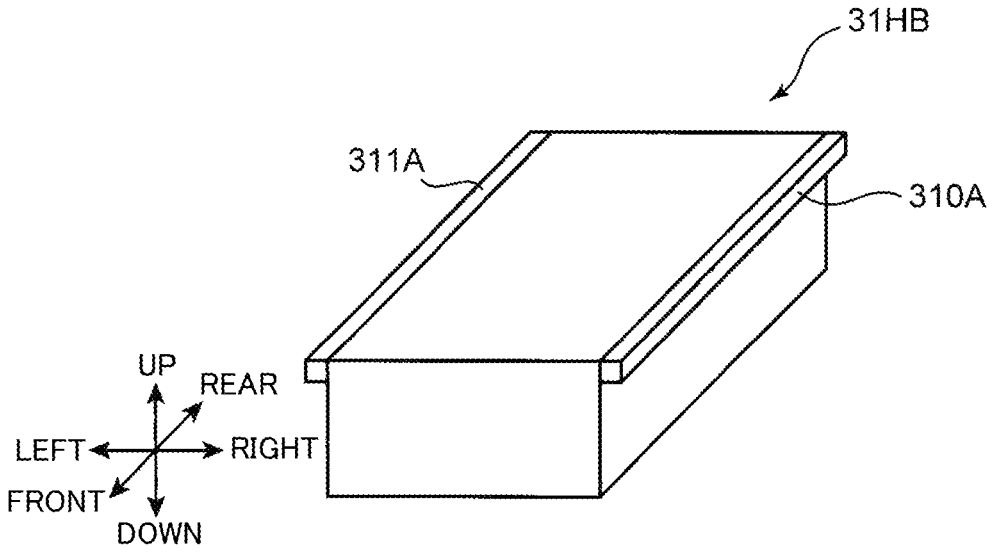
FIG. 11 is a perspective view of the drum unit according to the other embodiment of the present disclosure.
Figure 12:
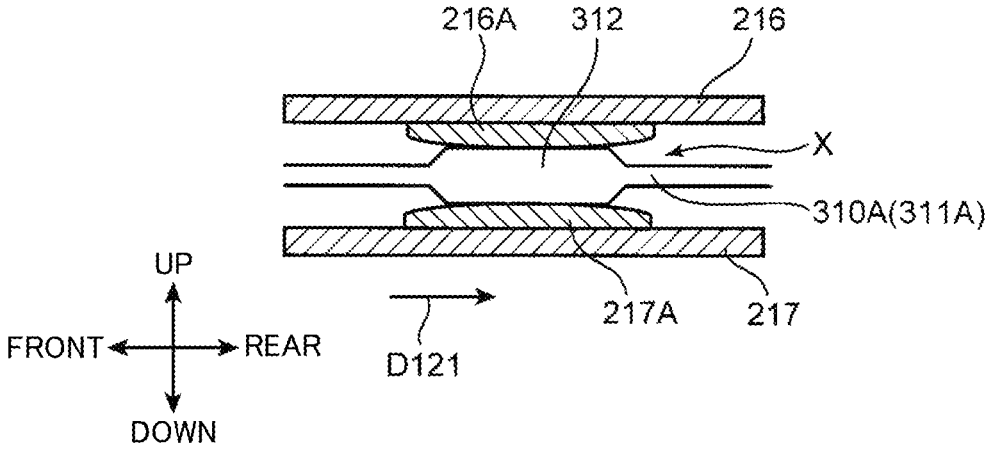
FIG. 12 is an enlarged view of the vicinity of a contacted portion of the drum unit according to the other embodiment of the present disclosure.

Next, a third embodiment of the present disclosure will be described. FIG. 10 is a schematic side view of a state where a drum unit 31HB according to the present embodiment is mounted on a frame 210B. In addition, FIG. 11 is a schematic perspective view of the drum unit 31HB. Furthermore, FIG. 12 is an enlarged view of a contact portion and a contacted portion in the present embodiment. It is noted that the present embodiment also differs from the above first embodiment in the configurations of the contact portion and the contacted portion, and thus the difference will be mainly described and the description of the other portion is omitted.

Also in the present embodiment, the frame 210B includes a pair of a front frame 211B and a rear frame 212B which are provided in a standing manner so as to extend in the front-rear direction. In addition, the front frame 211B and the rear frame 212B are connected to each other in the front-rear direction by a connection frame 213B. The drum unit 31HB includes a right insertion piece 310A and a left insertion piece 311A each of which is provided along the front-rear direction so as to project in the right-left direction (FIG. 11). The right insertion piece 310A and the left insertion piece 311A are engaged with a right rail portion 214A and a left rail portion 215A on the connection frame 213B, and the drum unit 31HB is mounted on the frame 210B toward the direction of an arrow D101 in FIG. 10.

Furthermore, each of the right rail portion 214A and the left rail portion 215A includes an upper guide 216 and a lower guide 217. The upper guide 216 and the lower guide 217 are members provided in the internal space S so as to extend along the axial direction (front-rear direction). A guide groove G having a predetermined groove width in a direction (the up-down direction) intersecting the axial direction is formed between the upper guide 216 and the lower guide 217.

Meanwhile, the right insertion piece 310A and the left insertion piece 311A of the drum unit 31HB are rib members provided so as to project from right and left side surfaces of the drum unit 31HB. The right insertion piece 310A and the left insertion piece 311A are provided so as to extend along the axial direction, and are inserted through the guide grooves G formed by the upper guides 216 and the lower guides 217.

Referring to FIG. 12, an upper restricting portion 216A and a lower restricting portion 217A are disposed on center portions, in the axial direction, of the upper guide 216 and the lower guide 217. The upper restricting portion 216A is a curved surface provided at the center portion, in the axial direction, of the upper guide 216 so as to project downward. In addition, the lower restricting portion 217A is a curved surface provided at the center portion, in the axial direction, of the lower guide 217 so as to project upward. In other words, a reduced portion X in which the groove width is set so as to be partially narrower than that of the other region of the guide groove G is formed at a center portion, in the axial direction, of the guide groove G by the upper restricting portion 216A and the lower restricting portion 217A. In the present embodiment, the reduced portion X serves as a contact portion. Meanwhile, in a state where the drum unit 31HB is mounted on the frame 210, a projection portion 312 having curved surfaces projecting from an upper surface and a lower surface of the rib member is disposed at a center portion, in the axial direction, of each of the right insertion piece 310A and the left insertion piece 311A and in a position opposing the reduced portion X.

That is, the drum unit 31HB is inserted along the connection frame 213B in the direction of the arrow D101 in FIG. 10 and the direction of an arrow D121 in FIG. 12, and is mounted on the frame 210B. In this case, the reduced portions X come into contact with the projection portions 312 of the right insertion piece 310A and the left insertion piece 311A of the drum unit 31HB. It is noted that the positions of the projection portions 312, the upper restricting portions 216A, and the lower restricting portions 217A are previously set such that a center portion of a cleaning blade which is not shown and is disposed within the drum unit 31HB is pressed toward a photosensitive drum. As a result, a pressing force of the cleaning blade is kept uniform along the axial direction. By the right insertion piece 310A and the left insertion piece 311A of the drum unit 31HB being inserted through the guide grooves G of the frame 210B, an insertion movement of the drum unit 31HB into the internal space S is favorably guided. In addition, by the projection portions 312 of the left insertion piece 311A and the right insertion piece 310A being brought into contact with the reduced portions X, the position of the center portion of the drum unit 31HB is adjusted in conjunction with the above insertion movement.

In another embodiment, a configuration may be set in which only the upper restricting portion 216A is disposed and the lower restricting portion 217A is not disposed. In addition, the projection portions 312 may not be disposed in the right insertion piece 310A and the left insertion piece 311A. When the center portion, in the axial direction, of the drum unit 31HB warps upward, the upper restricting portions 216A come into contact with upper surfaces of the right insertion piece 310A and the left insertion piece 311A and press the right insertion piece 310A and the left insertion piece 311A downward. As a result, it is possible to adjust the position of the center portion, in the axial direction, of the drum unit 31HB.

As described above, according to the above embodiment, the drum unit 31H supports the cleaning blade 351, and is fixed to the lower housing 21 after being inserted into the internal space S of the lower housing 21. The cleaning blade 351 is provided so as to extend along the axial direction of the photosensitive drum 121 and contacts with the cylindrical surface 121B of the photosensitive drum 121. When the drum unit 31H has warped in the axial direction, the members supported within the drum unit 31H, such as the cleaning blade 351, are likely to deform under the influence of the warp. Even in such a case, according to the above configuration, by the drum unit 31H being inserted into the internal space S and the contact portion such as the corrective pin 80P coming into contact with the contacted portion such as the standing wall 70, the position of the center portion, in the axial direction, of the drum unit 31H is adjusted in a cross section intersecting the axial direction. As a result, the warp of the drum unit 31H is favorably corrected, and the cleaning blade 351 is stably supported by the drum unit 31H. Thus, the pressing force of the cleaning blade 351 to the photosensitive drum 121 is stably kept. In addition, since the contact portion disposed in the lower housing 21 comes into contact with the contacted portion of the drum unit 31H, a decrease in the corrective force is suppressed even in use for a long period of time, as compared to the case where a corrective means is disposed within the drum unit 31H. In addition, by the contact portion coming into contact with the contacted portion, the pressing force at the center portion, in the axial direction, of the cleaning blade 351 is allowed to come close to the pressing force at each of both end portions, in the axial direction, of the cleaning blade 351. Thus, uniformity of the pressing force of the cleaning blade 351 in the axial direction is favorably improved.

Although the image forming apparatus according to the embodiment of the present disclosure has been described above, the present disclosure is not limited to this and, for example, the following alternative embodiments are possible.

(1) In the above embodiment, the drum unit 31H integrally supports the photosensitive drum 121 and the cleaning blade 351, but the present disclosure is not limited to this. The cleaning blade 351 may be mounted in the lower housing 21 independently of the photosensitive drum 121 in a state of being supported by the cleaner housing 35H.

(2) In the above embodiment, the drum unit 31H is mounted in the lower housing 21 along the axial direction of the rotational axis 121A of the photosensitive drum 121, but the present disclosure is not limited to this. In particular, in the above second embodiment, the drum unit 31H may be mounted in the lower housing 21 in the right-left direction (a direction intersecting the rotational axis 121A).

(3) In the above first embodiment, the corrective pin 80P is inserted through the hole 70H of the standing wall 70. A tapered portion which is not shown may be formed at an opening of the hole 70H. The insertion of the corrective pin 80P into the hole 70H is favorably guided by the tapered portion. Thus, even when the unit housing 31K has warped, the corrective pin 80P is stably inserted into the hole 70H.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body having an internal space;

a photosensitive drum having a rotational axis and a circumferential surface, disposed in the internal space, and configured to rotate around the rotational axis and to carry a toner image on the circumferential surface;

a housing fixed to the apparatus main body after being inserted into the internal space in a direction along an axial direction of the rotational axis;

a cleaning blade formed of a plate-shaped elastic member provided so as to extend in the axial direction of the rotational axis, supported by the housing, and contacting with the circumferential surface of the photosensitive drum to clean the photosensitive drum;

a contact portion disposed in the apparatus main body so as to oppose the housing, the contact portion being a pin which is provided so as to extend along the axial direction and has an outer circumferential surface; and a contacted portion disposed at a center portion, in the axial direction, of the housing and contacted with by the contact portion, the contacted portion being a standing wall which is provided in a standing manner on the center portion of the housing and has a positioning hole into which the pin is inserted, wherein a position of the center portion, in the axial direction, of the housing is adjusted in a cross section intersecting the axial direction by the housing being inserted into the internal space and the outer circumferential surface of the pin coming into contact with an inner circumferential surface of the standing wall which inner circumferential surface is formed by the positioning hole.

2. The image forming apparatus according to claim 1, wherein the pin is made of a metallic material.

3. The image forming apparatus according to claim 1, further comprising a tapered portion formed at an opening of the positioning hole and configured to guide insertion of the pin into the positioning hole.

4. The image forming apparatus according to claim 1, wherein the housing includes a pair of side walls provided in a standing manner at both end portions in the axial direction and a connection wall connecting the pair of side walls to each other in the axial direction, and the cleaning blade is disposed between the pair of side walls.

5. The image forming apparatus according to claim 4, wherein the housing is made of a resin material.

6. The image forming apparatus according to claim 1, wherein the housing further supports the photosensitive drum configured to carry the toner image.

7. An image forming apparatus comprising:

an apparatus main body having an internal space;

a photosensitive drum having a rotational axis and a circumferential surface, disposed in the internal space, and configured to rotate around the rotational axis and to carry a toner image on the circumferential surface;

a housing fixed to the apparatus main body after being inserted into the internal space in a direction along an axial direction of the rotational axis;

a cleaning blade formed of a plate-shaped elastic member provided so as to extend in the axial direction of the rotational axis, supported by the housing, and contacting with the circumferential surface of the photosensitive drum to clean the photosensitive drum;

a guide groove provided in the apparatus main body so as to extend along the axial direction in the internal space and having a predetermined groove width in a direction intersecting the axial direction;

a guide member provided in the housing so as to extend along the axial direction and inserted through the guide groove;

a contact portion disposed in the apparatus main body so as to oppose the housing, the contact portion being a reduced portion of the guide groove which reduced portion is at a center portion, in the axial direction, of the guide groove and in which reduced portion the groove width is set so as to be partially narrower than that of another region of the guide grooves; and a contacted portion of the center portion, in the axial direction, of the housing, the contacted portion being an outer wall portion of the guide member which outer wall portion is contacted with by the reduced portion, wherein a position of the center portion, in the axial direction, of the housing is adjusted in a cross section intersecting the axial direction by the housing being inserted into the internal space and the reduced portion of the guide groove coming into contact with the outer wall portion of the guide member.

8. The image forming apparatus according to claim 7, wherein the guide member has a predetermined guide width smaller than the groove width in the direction intersecting the axial direction and is provided so as to extend in the axial direction, and the guide width at the outer wall portion is set so as to be partially larger than the guide width in another region of the guide member in the axial direction.

* * * * *

UNITED STATES PATENT AND TRADEMARK OFFICE

CERTIFICATE OF CORRECTION

PATENT NO. : 9,128,451 B2
APPLICATION NO. : 14/169070
DATED : September 8, 2015
INVENTOR(S) : Mitsuhiro Goda and Susumu Hanano It is certified that error appears in the above-identified patent and that said Letters Patent is hereby corrected as shown below:

In the claims, column 15, line 2, delete “grooves” and insert --groove--.

Signed and Sealed this
Twenty-third Day of February, 2016

Michelle K. Lee

Michelle K. Lee
*Director of the United States Patent and Trademark Office*